US006642491B1

(12) United States Patent
Törngren et al.

(10) Patent No.: US 6,642,491 B1
(45) Date of Patent: Nov. 4, 2003

(54) MICROWAVE OVEN AND CONTROLLING OF THE SAME

(75) Inventors: Per Åke Törngren, Nowkōping (SE); Birgitta Tua Kidblad, Norrkōping (SE); Anders Reinhold Wikstrom, Nonköping (SE)

(73) Assignee: Whirlpool Corporation, Benton Harbor, MI (US)

( * ) Notice: Subject to any disclaimer, the term of this patent is extended or adjusted under 35 U.S.C. 154(b) by 136 days.

(21) Appl. No.: 10/018,522

(22) PCT Filed: Jun. 16, 2000

(86) PCT No.: PCT/EP00/05566

§ 371 (c)(1),
(2), (4) Date: Dec. 14, 2001

(87) PCT Pub. No.: WO01/01733

PCT Pub. Date: Jan. 4, 2001

(30) Foreign Application Priority Data

Jun. 24, 1999 (CH) ..... 9902423

(51) Int. Cl.[7] ..... H05B 6/68

(52) U.S. Cl. ..... 219/705; 219/707; 99/325

(58) Field of Search ..... 219/705, 707, 219/703, 704, 716, 715, 718, 719, 518, 492; 99/325

(56) References Cited

U.S. PATENT DOCUMENTS 4,831,239 A * 5/1989 Ueda ..... 219/518
4,874,928 A * 10/1989 Kasai ..... 219/492
5,889,264 A * 3/1999 Kidblad et al. ..... 219/707

* cited by examiner

*Primary Examiner*—Quang T. Van
(74) *Attorney, Agent, or Firm*—Thomas J. Roth; Robert O. Rice; John F. Colligan

(57) ABSTRACT

A process for controlling a cooking operation in a microwave oven as well as a microwave oven therefor. Subsequent to a heating step at full power for bringing cooking liquid to the boil, foodstuff which is to be cooked is added, whereupon continued moisture sensor controlled heating begins, initially at full power, until boiling resumes, whereupon moisture sensor controlled simmering/boiling takes place during a cooking time. During an initial time period of the continued moisture sensor controlled heating, the moisture sensor action is inhibited.

16 Claims, 4 Drawing Sheets

MICROWAVE OVEN AND CONTROLLING OF THE SAME

FIELD OF THE INVENTION

The present invention relates to a process for a microwave oven for controlling a cooking operation as well as a microwave oven for implementing such a process.

BACKGROUND OF THE INVENTION AND PRIOR ART

A microwave oven typically comprises an oven cavity, a microwave source, a feeding system for feeding microwaves to the cavity, a control unit for controlling the power level and the time during which the microwaves are fed to the oven cavity, and means connected to the control unit for setting and/or calculating a cooking time for a solid or liquid foodstuff.

Various technologies have been proposed for sensor-controlled automation of the cooking operation, for example as described in U.S. Pat. No. 4,791,263 and our own Swedish Patent 9602159-7 (SE-C2-506.605).

However, the usability of these prior technologies is limited, since it is desirable that the user of the oven should be able to intervene during the actual cooking operation for various reasons.

SUMMARY OF THE INVENTION

The object of the present invention is to enable sensor controlled automatic cooking of a foodstuff utilising high power—and, therefore, a short cooking time—and with full control even when there are user-initiated interruptions to the cooking operation.

It is a special object to enable such cooking in cases where the user first brings a cooking liquid to the boil and then places foodstuffs in the cooking liquid in order to cook them by boiling them.

The above objects are achieved according to the invention by a process and a microwave oven exhibiting the features stated in the appended claims.

The invention is thus based on the insight that special measures should be taken concerning the utilisation of sensor signals for control in connection with transitional phenomena which may occur when the user initiates an interruption in the cooking process, which interruption results in a hold time, during which the sensor signals may change in such an unfavourable way that there is a risk that the result of the automatic cooking process will be incorrect.

According to the invention, such a situation is handled by inhibiting the sensor control action for a period of time in connection with said hold time.

The invention is particularly suitable when said sensor is a moisture sensor, in which case there is a risk that the output signal from the sensor will be incorrectly high from a control point of view in connection with an interruption as a result of an uncontrolled moisture increase in the oven cavity, for example because the user lifts a lid placed on the vessel in which cooking is in progress.

According to the invention, it is advantageous if the heating before the hold time caused by the interruption as well as the continued heating until sensor-detected boiling takes place at high, preferably full, or at least essentially full power, after which simmering or boiling takes place during a certain cooking time. By inhibiting the sensor action during at least a certain period of time in connection with the continued heating one ensures that the simmering/boiling will begin at the right time.

According to the invention it is thus preferable for the heating to take place in a number of heating steps, comprising a first step before the interruption hold time, when, for example, the user places foodstuffs in at least essentially boiling cooking liquid, a second step when the liquid is brought to the boil again, and a third step when program-controlled simmering/boiling takes place. In this connection, the second step preferably begins with said time period when the sensor control is inhibited. When said time period has come to an end, the oven conditions have stabilised subsequent to the interruption hold time, so that the sensor output signal can safely be used for controlling the time of the transition from the second to the third heating step.

The length of the first heating step is advantageously also sensor controlled such that a sensor detects when the liquid begins to boil, whereupon the heating is interrupted and an output signal is given to the user, so that he can take the necessary measures during the resulting hold time.

Although it is possible to use separate sensors during the first heating step and the continued heating, according to the invention it is preferable to use the same sensor, which specifically can be a moisture sensor.

When a user takes some action during the interruption hold time, such as lifting the lid of the vessel and placing a foodstuff, e.g. pasta, in the boiling liquid, a large amount of additional moisture may accumulate in the oven cavity. When the oven is re-started the moisture will gradually be ventilated, but is has been found that there is a considerable risk that the moisture sensor will give an incorrect signal in connection with a restart, which signal prematurely indicates that boiling has resumed and, consequently, the cooking liquid will not be brought to the boil as desired. This problem is obviated by the invention, whereby, for a certain time subsequent to a re-start, the control system of the oven becomes insensitive to the moisture level inside the oven cavity. In this connection, high, preferably full, microwave power can preferably be applied also during the above-mentioned time period.

It has been found that because it can be expected that the time required to bring the cooking liquid to the boil is a function of the amount of the liquid and the time required for efficient ventilation of the moisture subsequent to a re-start can also be expected to be a function of the amount of the liquid, said time period of inhibited sensor action can advantageously be based on the time required to bring the liquid to the boil during the first heating step. The length of the time period can thus preferably be set to a certain fraction of the time required to bring the liquid to the boil, typically said time divided by about 16. As the person skilled in the art will readily appreciate, the time required can easily be determined by the control unit of the oven. Suitably, the actual heating time, taking into consideration any interruptions in the microwave feed, is utilised for this purpose.

As an alternative and/or a complement, the length of said time period could be related to the amount or character of the foodstuff, about which information can be inputted to the control unit of the oven by the user in the usual manner.

It has been found suitable to choose the length of said time period to be at least a predetermined minimum time, which typically can be about 20 seconds.

According to the invention, in connection with the first heating step, it is suitable to indicate to the user that the liquid is beginning to boil, after which the continued heating subsequent to the interruption hold time does not start until initiated by the user.

The third heating step of simmering/boiling during a cooking time advantageously takes place in a closed loop based on feedback from a sensor, which is preferably the same sensor that controls the initiation of the third heating step.

The cooking time of the third heating step can be set, for example by the time or food type inputted by the user, but it is, of course, also possible to relate the cooking time of the third step to sensor information obtained during the cooking operation, specifically the length of the first heating step and/or the length of the second heating step.

The third heating step, as well as the rest of the cooking operation where applicable, is suitably implemented according to the description in our above-mentioned Swedish patent 9602159-7, which is herewith incorporated by reference.

The invention will be described in more detail below by way of a non-restricting embodiment of the control process according to the invention and a microwave oven for implementing the same, with reference to the accompanying drawings.

DESCRIPTION OF AN EMBODIMENT

Figure 1:
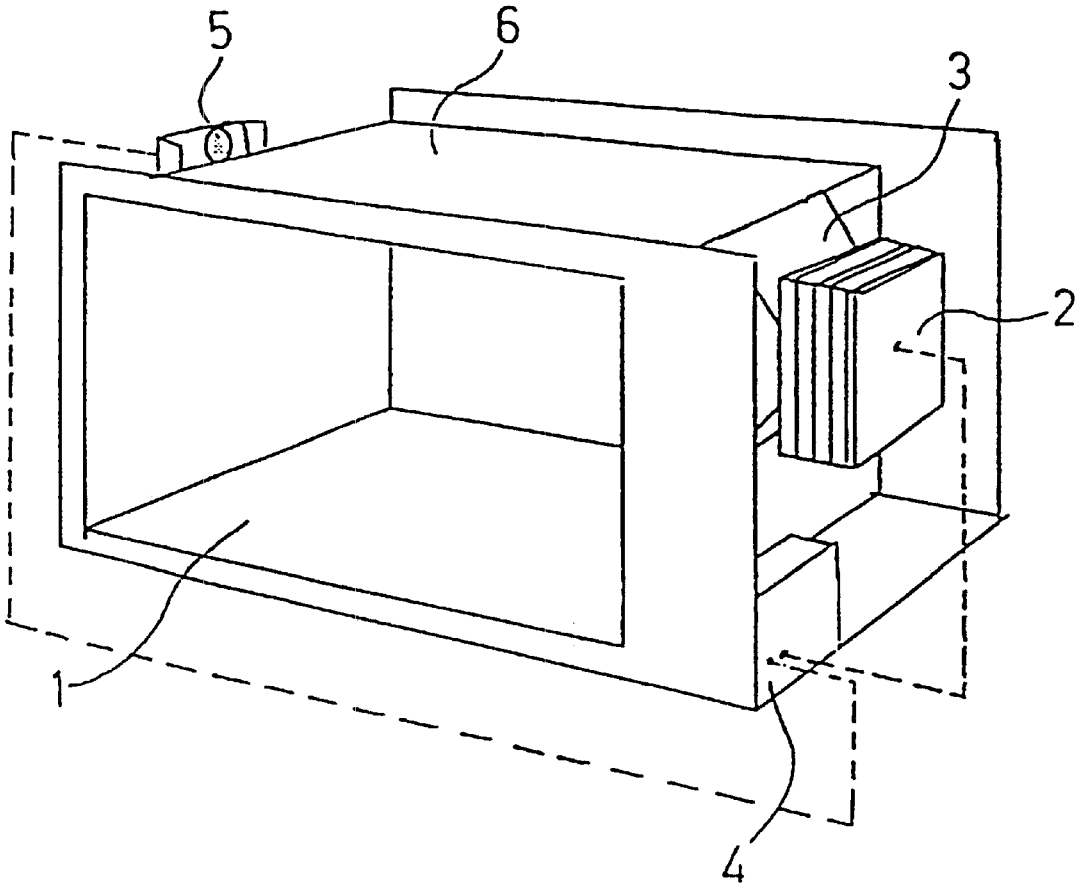
FIG. 1 schematically shows the relevant parts of an embodiment of a microwave oven according to the invention.

FIG. 1 shows the relevant parts of a microwave oven according to an embodiment of the invention, comprising an oven cavity 1, a microwave source 2, a feeding system 3 for feeding microwaves from the microwave source to the cavity, a microprocessor-based control unit 4 for controlling optional, stored cooking programs depending on information inputted by way of the control panel (not shown) of the oven, as well as a moisture sensor 5 which is arranged in the ventilation air passage from the cavity for detecting the humidity of the ventilation air. Depending on the design of the ventilation air passage, the moisture sensor 5 can be located in different places. For the sake of simplicity, the connections between the moisture sensor 5, the microwave source 2, and the control unit 4 are indicated by dashed lines. In FIG. 1, the casing of the oven including the control panel and the front door for closing the cavity have been removed. The details of the mechanical and electrical structure of the oven are not relevant to the description of the invention and have therefore been omitted. Instead, the reader may refer to the Whirlpool AVM215 microwave oven, which is manufactured and sold by the Applicant. This oven is provided with a grill element and has the following technical specifications: supply voltage 240 V/50 Hz; wattage 2850 W; microwave power 1000 W; grilling power 1200 W; electronic timer; exterior dimensions 330×553×477 mm; oven cavity dimensions 227×375×395 mm; optional microwave power levels by way of program control.

In the described embodiment of the microwave oven according to the invention, the microwave power supplied is controlled by means of so-called pulsing of the microwave source 2, which is normally a magnetron, which means that the power supply is divided into power cycles and that the magnetron is connected at full power during an optional part of the total length of the cycle, whereby the power level is formed of the average power during the cycle. This type of power control is utilised in the above oven. It will be appreciated that the process according to the invention can also be used. for other types of microwave power control, for example the switch mode type, provided, however, that the power supply can be divided into power cycles of a suitable length.

Figures 2A, 2B:
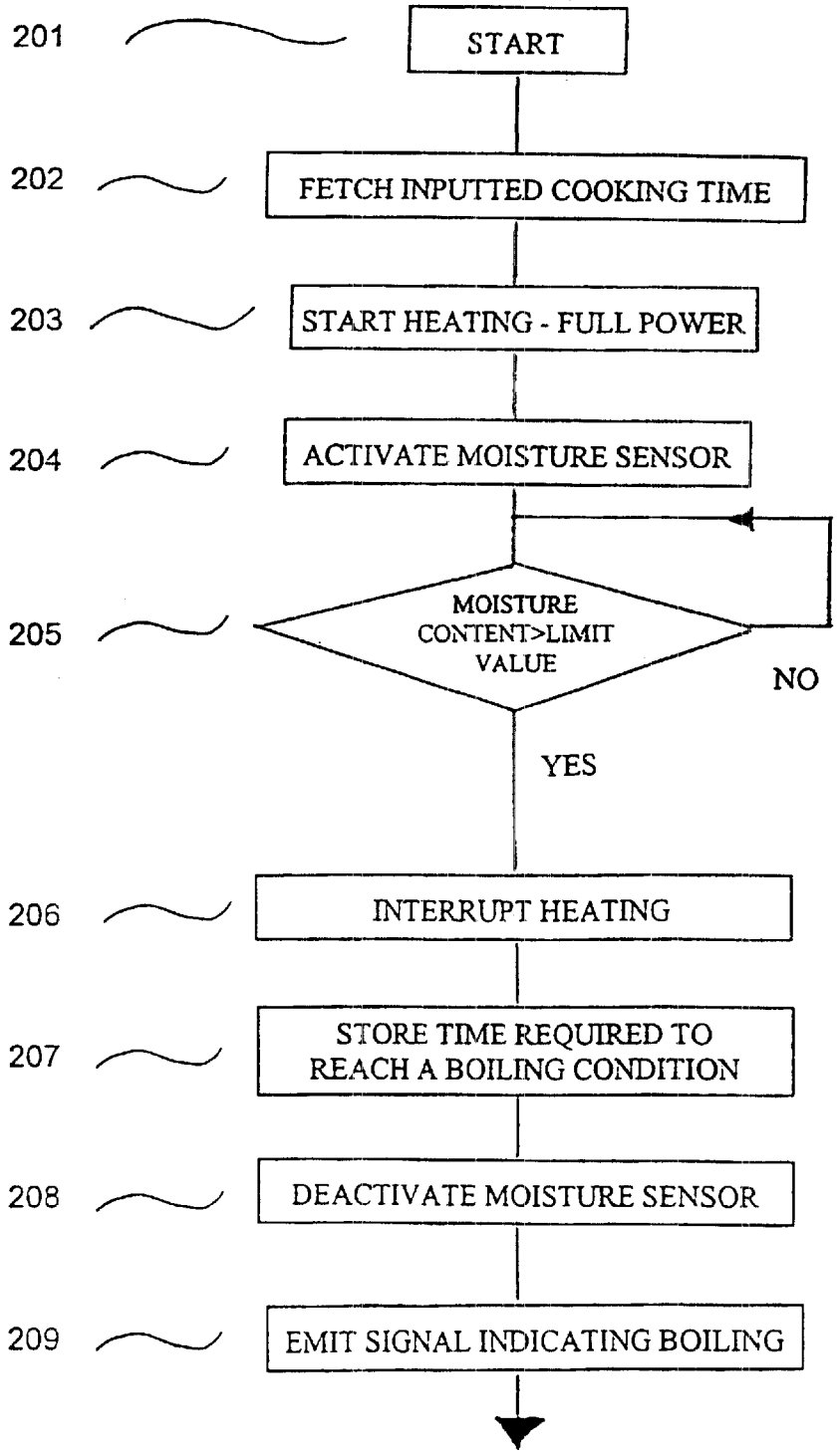
FIGS. 2*a* and 2*b* show a general flow chart of a control program for controlled cooking according to an embodiment of the invention.

An example of the utilisation of an embodiment of the invention for cooking pasta will now be described with reference to FIG. 2 (consisting of FIGS. 2*a* and 2*b* in sequence) and FIG. 3.

Figure 2B:
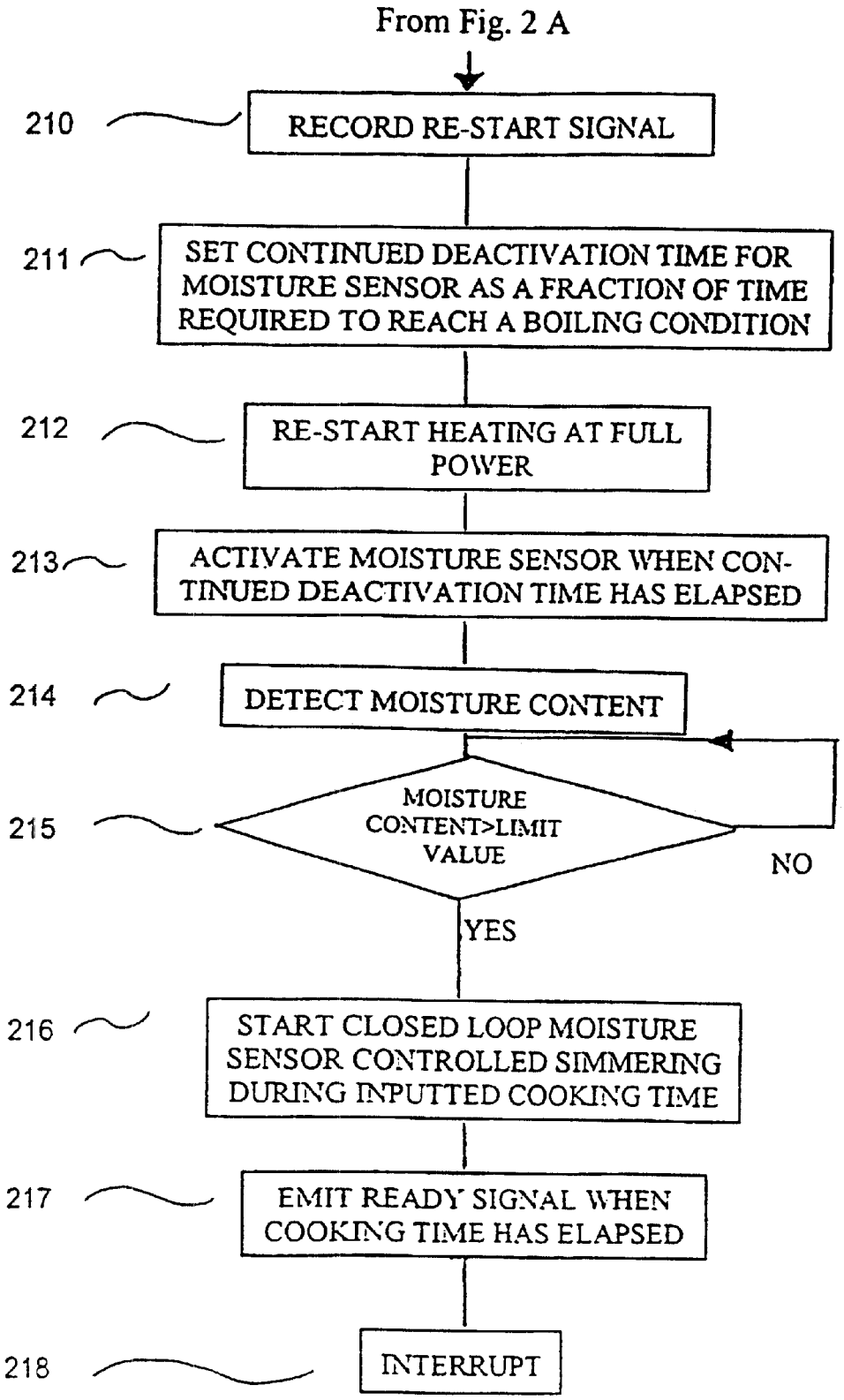
Figure 3:
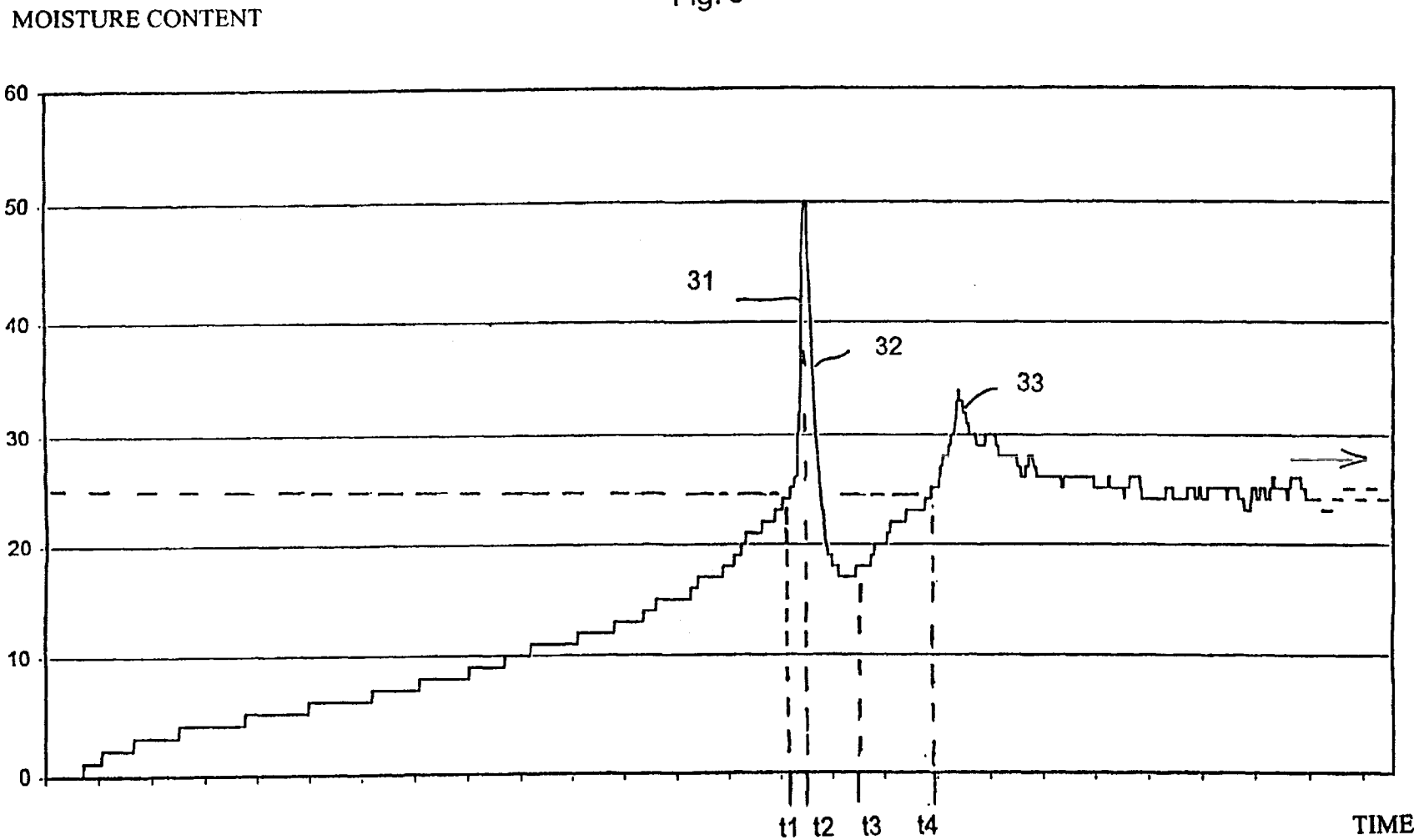
FIG. 3 is a curve chart showing an example of the output signal from a moisture sensor as a function of time when carrying out a cooking operation in accordance with an embodiment of the invention.

The user places a vessel having a lid and containing cooking liquid in the oven cavity of the microwave oven, inputs cooking program data consisting of the type of food and the cooking time, and starts the oven, corresponding to the time 0 in FIG. 3 and block 201 in FIG. 2. The control unit 4 of the oven fetches the inputted cooking time (202), starts feeding microwaves into the oven cavity at full power (block 203), and activates the moisture sensor 5 (block 204), i.e. records the sensor's out=put signal, which is a measurement of the moisture content inside the oven cavity. The control unit compares the moisture content obtained from the moisture sensor with a stored first moisture content limit value, which has been empirically determined to correspond to reaching a boiling condition (block 205). In this example, the limit value is 25.

At the time t1, a moisture content corresponding to the first limit value is detected, whereupon the control unit interrupts the microwave feed (block 206), records the heating time used thus far (block 207), deactivates the moisture sensor action (block 208), and emits a signal (block 209) indicating to the user that the cooking liquid has reached the boiling temperature.

Now, the user opens the oven door, removes the lid from the vessel, whereupon a great deal of steam escapes into the oven cavity, adds the pasta which is to be cooked, replaces the lid and closes the oven door. The escaping steam causes the moisture content to increase rapidly and significantly in the oven cavity, as indicated by the curve sequence at 31 in FIG. 3.

At the time t2, corresponding to the peak of the curve in FIG. 3, the user re-starts the oven, which the control unit records (block 210). The control unit calculates a continued deactivation time for the moisture sensor action as a fraction of the previously determined time required to bring the liquid to the boil and keeps the moisture sensor deactivated during this time (block 211). In the example shown, the time required to bring the liquid to the boil is about 900 seconds and the calculated continued deactivation time is about 60 seconds. In this preferred embodiment, the control unit also restarts heating without delay at full power (block 212) in order quickly to return to boiling.

The re-starting of the oven results in the ventilation of the "extra" moisture inside the oven cavity, i.e. the moisture content quickly decreases, as indicated by the curve sequence at 32 in FIG. 3, to a lowest level in order to gradually increase again as the continued heating at full power progresses.

At the time t3, the moisture sensor action is reactivated for the purpose of detecting that boiling has resumed (block 213 and 214). When the detected moisture content reaches a second, empirically determined limit value (which in the present example is equal to the first limit value), i.e. when boiling resumes (block 215), the control unit interrupts the microwave feed at full power and starts moisture sensor controlled simmering at lower power during a time period which is equal to the inputted cooking time (block 216). The transition to the moisture value corresponding to simmering gives an overshoot 33 in the moisture content curve in FIG. 3, which can be at least partially counteracted by stopping the heating for a short time, typically about 10 seconds, subsequent to the detection of resumed boiling. Advantageously, the simmering control is effected in complete accordance with the description in our above-mentioned patent. When the cooking time has elapsed (not shown in FIG. 3), a ready signal is given (block 217) and the cooking operation is interrupted (block 218).

What is claimed is:

1. A process for a microwave oven for controlling an operation for cooking a foodstuff arranged in the microwave oven, said process comprising:

supplying microwaves at essentially full power during a first heating step for quick heating to at least a boiling condition, detecting by means of a first sensor a parameter indicating when a boiling condition has been reached, and maintaining simmering or boiling controlled by means of a second, boiling-detecting sensor to the extent desired during a cooking time, wherein the first heating step is interrupted when the boiling condition is detected by the first sensor, and microwaves are supplied, in a second heating step subsequent such interruption, preferably at full power, until boiling resumes, said second heating step beginning with a time period without control by means of said second sensor.

2. A process according to claim 1, wherein a moisture sensor is used as said second sensor and preferably also said first sensor.

3. A process according to claim 2, wherein the length of said time period without control by means of said second sensor is related to the amount and/or characteristics of the foodstuff and/or to the amount of liquid in which the foodstuff is cooked.

4. A process according to claim 3, wherein the length of said time period is related to the time required to reach a boiling condition for the first time.

5. A process according to claim 4, wherein the time required to reach a boiling condition consists of the actual sensor-controlled heating time during the first heating step taking into consideration any interruptions and re-starts.

6. A process according to claim 5, wherein the length of said time period is set to a predetermined fraction of the time required to reach a boiling condition, typically the time required to reach a boiling condition divided by about 16.

7. A process according to claim 6, wherein said time period is chosen to be greater than a predetermined minimum time, which is typically about 20 seconds.

8. A process according to claim 7, wherein said hold time is determined by a user-related action and re-starting is subsequently initiated by the user.

9. A process according to claim 8, wherein said hold time is determined by a user-performed supplementation with respect to the foodstuff.

10. A process according to claim 9, wherein a cooking liquid is first brought to the boil during the first heating step and the foodstuff is subsequently placed in the cooking liquid, whereupon the second heating step is begun.

11. A process according to claim 10, wherein the heating takes place in a vessel covered with a lid at least during the first heating step and wherein said hold time comprises lifting or removing the lid.

12. A process according to claim 11, wherein the detection of a boiling condition is indicated to the user and wherein the second heating step is begun subsequent to being initiated by the user.

13. A process according to claim 12, wherein the third heating step takes place in a closed loop based on feedback from a sensor, which is preferably said second sensor.

14. A process according to claim 13, wherein the length of the cooking time of the third heating step is related to sensor information obtained during the process, specifically the length of the first heating step and/or the length of the second heating step.

15. A microwave oven comprising a ventilated oven cavity (1), a microwave source (2), a feeding system (3) for feeding microwaves into the oven cavity, a program-controlled microprocessor control unit (4) for controlling the power level and the feeding time for the microwaves which are fed into the oven cavity, at least one moisture sensor (5) arranged to detect the humidity of the ventilation air from the cavity and in connection with the control unit, as well as control means connected to the control unit for setting cooking data for a foodstuff, comprising a microprocessor control unit is programmed to carry out a cooking operation in several steps, comprising a first heating step for quickly heating a foodstuff to at least essentially a boiling condition, during which microwaves are fed into the oven cavity at full or essentially full power, the power supply being interrupted when a first moisture sensor (5) detects a predetermined moisture value, and a further heating step during which the microwave power supplied is controlled depending on moisture level feedback from a second moisture sensor in order to maintain a moisture value corresponding to the desired degree of simmering or boiling during a cooking time for the foodstuff, said further heating step beginning subsequent to a hold time and subsequent to being initiated by an oven user and comprising a second heating step at high, preferably full or essentially full power until boiling resumes, in connection with, specifically during, the beginning of which the control action of the second moisture sensor is removed for a period of time, as well as a third heating step of closed-loop-controlled simmering or boiling during said cooking time.

16. A microwave oven according to claim 15, wherein the microprocessor control unit is programmed to measure the time required for heating to a boiling condition during the first heating step and to determine the length of said time period as a predetermined fraction thereof.

* * * * *